United States Patent [19]

Lohrmann et al.

[11] Patent Number: 5,054,759

[45] Date of Patent: Oct. 8, 1991

[54] APPARATUS FOR FEEDING INDIVIDUAL SHEETS IN OFFICE MACHINES

[75] Inventors: Gerhard Lohrmann, Elchingen; Michael Setz, Beimerstetten, both of Fed. Rep. of Germany

[73] Assignee: Mannesmann Aktiengesellschaft, Dusseldorf, Fed. Rep. of Germany

[21] Appl. No.: 457,282

[22] Filed: Dec. 27, 1989

[30] Foreign Application Priority Data

Dec. 27, 1988 [DE] Fed. Rep. of Germany ..... 3844325

[51] Int. Cl.[5] ..... B65H 3/30

[52] U.S. Cl. ..... 271/22; 271/127; 271/162; 400/624

[58] Field of Search ..... 271/22, 126, 127, 147, 271/157, 160, 162, 164; 400/624; 100/915

[56] References Cited

U.S. PATENT DOCUMENTS

| | | | |
|---|---|---|---|
| 3,799,538 | 3/1974 | Suzuki | 271/162 |
| 4,023,792 | 5/1977 | Punnett et al. | 271/22 |
| 4,387,889 | 6/1983 | Koyama et al. | 271/22 X |
| 4,406,448 | 9/1983 | Kulpa et al. | 271/160 |
| 4,711,442 | 12/1987 | Runzi | 271/22 |
| 4,714,243 | 12/1987 | Staniszewski | 271/22 X |
| 4,765,605 | 8/1988 | Abbott | 271/127 X |

FOREIGN PATENT DOCUMENTS

| | | | |
|---|---|---|---|
| 3535802 | 4/1987 | Fed. Rep. of Germany | 400/624 |
| 0052833 | 4/1980 | Japan | 271/160 |
| 0093743 | 7/1980 | Japan | 271/127 |
| 0140437 | 11/1980 | Japan | 271/127 |
| 0048541 | 3/1982 | Japan | 271/126 |
| 0087139 | 5/1985 | Japan | 271/157 |
| 0119529 | 6/1986 | Japan | 271/147 |
| 0225082 | 10/1986 | Japan | 400/624 |
| 0031624 | 2/1987 | Japan | 271/127 |

*Primary Examiner*—Robert P. Olszewski
*Assistant Examiner*—James R. Bidwell
*Attorney, Agent, or Firm*—Cohen, Pontani & Lieberman

[57] ABSTRACT

In an apparatus for the feeding of individual sheets (1) into office machines (2) in which the individual sheets (1) form a stack (3) of sheets atop which rotatively-driven fixed delivery rolls (4) rest and from which individual sheets (1) can be drawn over separating corners (5) of a paper-receiving frame (6), the stack (3) of sheets lies on a spring-action swing plate (8) between lateral paper-guide frames (*7a*, *7b*). The invention provides for selectively alternative use, for supporting the sheet stack (3), of either the fixed paper-receiving frame (6) or of a separate and additional paper cassette (12) which is engageable with the machine (2) such that the spacing between the separating corners (30) on the cassette (12) and the circumference of the delivery rolls (4), when the cassette is mounted on the machine (2), is the same as the normal spacing between the separating corners (5) on the paper-receiving frame (6) and the circumference of the delivery rolls (4).

6 Claims, 4 Drawing Sheets

APPARATUS FOR FEEDING INDIVIDUAL SHEETS IN OFFICE MACHINES

FIELD OF THE INVENTION

The present invention relates to apparatus for effecting the feeding of individual sheets in office machines, such for example as dot-matrix printers, from a stack of sheets through driven rotation of fixed delivery rolls which rest on or otherwise engage said stack. It is more particularly directed to such apparatus wherein individual sheets are withdrawn from the stack and fed over separating corners of a paper-receiving frame and the stack of sheets rests supportedly atop a spring-action swing plate between laterally disposed paper-guide frames.

BACKGROUND OF THE INVENTION

Office machines, such for example as dot matrix printers and the like, typically hold or support or are otherwise configured for association with a refillable supply or stack of sheets of paper from which individual sheets are drawn for receiving the machines' printed output. Such stacks of sheets, which may consist of a hundred or more individual sheets, can be introduced either directly into paper-receiving frames which are, for this purpose, arranged in fixed relation to or on the machine (as disclosed in West German Patent No. 32 47 341 and the corresponding U.S. Pat. No. 4,613,124), or alternatively into removable paper cassettes which are filled with sheets while separated or disengaged from the office machine and are then introduced into existing cassette-receiving guides of the machine. Thus, the primary difference between these two types of paper feed arrangements is that, in the former, the stack of sheets is placed directly into or onto the paper-receiving frame of the office machine whereas, in the latter, the sheets are first inserted into a separate paper cassette remote from the office machine and the cassette is thereafter engaged with the machine. Both arrangements provide specific advantages which affect the purchase price of the office machine or the operation of such machines.

SUMMARY OF THE INVENTION

It is accordingly a particular object of the present invention to realize and attain the advantages of both these prior art arrangements for sheet-stack loading in an office machine.

This and other objects are achieved in accordance with the invention in an apparatus of this type by providing one or more swing plates which are moveable between a first spaced position in relatively close proximity to the delivery rolls and a second, relatively more remote position with respect to the fixed delivery rolls. The swing plates can be locked and/or unlocked in their second spaced position and, with the second spaced position set, an additional paper cassette consisting of a housing or container including a spring-action insertion bottom can be introduced into the apparatus in supported relation on the swing plate. This arrangement obviates the difficulties heretofore encountered in the prior art of attaining, whether the office machine is used with or without an additional paper cassette, a correct and consistent spacing of the sheet stack from the delivery rolls and separating corners and, furthermore, in assuring the application of a uniform pressure of the delivery rolls against the stack of sheets irrespective of the such spacing. In particular, the present invention advantageously enables insertion of the stack of sheets into the machine in the locked positions of the corresponding stack-supporting bases— i.e. of the swing plate or of the additional paper cassette.

The advantage of providing a locked stack-supporting "base" for the sheets to be introduced into feedable association with the machine may, in accordance with the invention, be implemented by providing a double-arm detent lever pivotally mounted on the apparatus frame and which acts on the swing plate, the detent lever including a second lever arm engageable with and disengageable from the apparatus frame.

In a currently preferred form of the invention, individual sheets fed from the stack travel between opposed lateral paper-guide frames. A swing shaft which extends over the width or spacing between the lateral paper-guide frames rests supportingly against the bottom of the swing plate and carries rotatively-supported gears on its shaft ends. A desired pivotal displacement of the swing plate through selective manual adjustment of the detent lever is obtained through captive engagement of the swing shaft with the detent lever so that, as the detent lever is pivotally moved, it correspondingly carries the swing shaft and supported swing plate along a displacement path. This path is defined through meshed engagement of the swing-shaft gears with arcuately extending racks which are associated with the lateral paper-guide frames and dimensioned in accordance with the intended swing radius of the detent lever. Thus, the cross-sectionally cylindrical swing-shaft is guided for movement along its displacement path by the arcuate racks as the detent lever is selectively pivotted by, for example, user manipulation of the lever.

A particularly noteworthy feature and improvement of the invention is the provision, in the additional paper cassette, of a spring-action insertion bottom and of separating corners arranged on the cassette frame, and in the ability to lock and unlock the swing-action insertion bottom of the cassette. The separating corners on the cassette operatively replace, during use of the additional cassette, those present in the sheet feeding apparatus with which the cassette is mountedly engageable.

The proper introduction and locking of the additional paper cassette is further facilitated by the provision on the cassette of lateral guides which fix the spacing, between the delivery roll peripheries or circumference and the separating corners of the inserted paper cassette, equal to the spacing between the delivery roll peripheries and the separating corners of the paper-guide frame on the apparatus. Thus, the delivery rolls to separating corners distance is the same whether sheets are fed to the office machine with or without a separate and additional paper cassette.

All operational requirements are further satisfied, in accordance with additional features of the invention, in that the spring-action insertion bottom of the additional paper cassette is maintained or held in a paper-receiving or filling position by means of an interlock member. Upon insertion of the additional paper cassette into engagement with the apparatus, the interlock member is automatically disengaged or unlocked so that the cassette insertion bottom, together with the stack of sheets, is driven upwardly (i.e. in the direction toward the top of the sheet stack) to drive the topmost sheet of the stack against the delivery rolls. Then, when the detent lever is unlocked, the full spring force or urgency of the spring-action swing plate or plates is transmitted and applied to the cassette frame so as to apply proper pressure by the topmost sheet in the stack against the delivery rolls.

Other objects and features of the present invention will become apparent from the following detailed description, considered in conjunction with the accompanying drawings, of a currently preferred embodiment of the invention. It is to be understood, however, that the drawings are designed solely for purposes of illustration and not as a definition of the limits of the invention, for which reference should be made to the appended claims.

BRIEF DESCRIPTION OF THE DRAWINGS

In the drawings, wherein similar reference characters denote similar elements throughout the several views.

DETAILED DESCRIPTION OF THE PREFERRED EMBODIMENT

Figure 1:
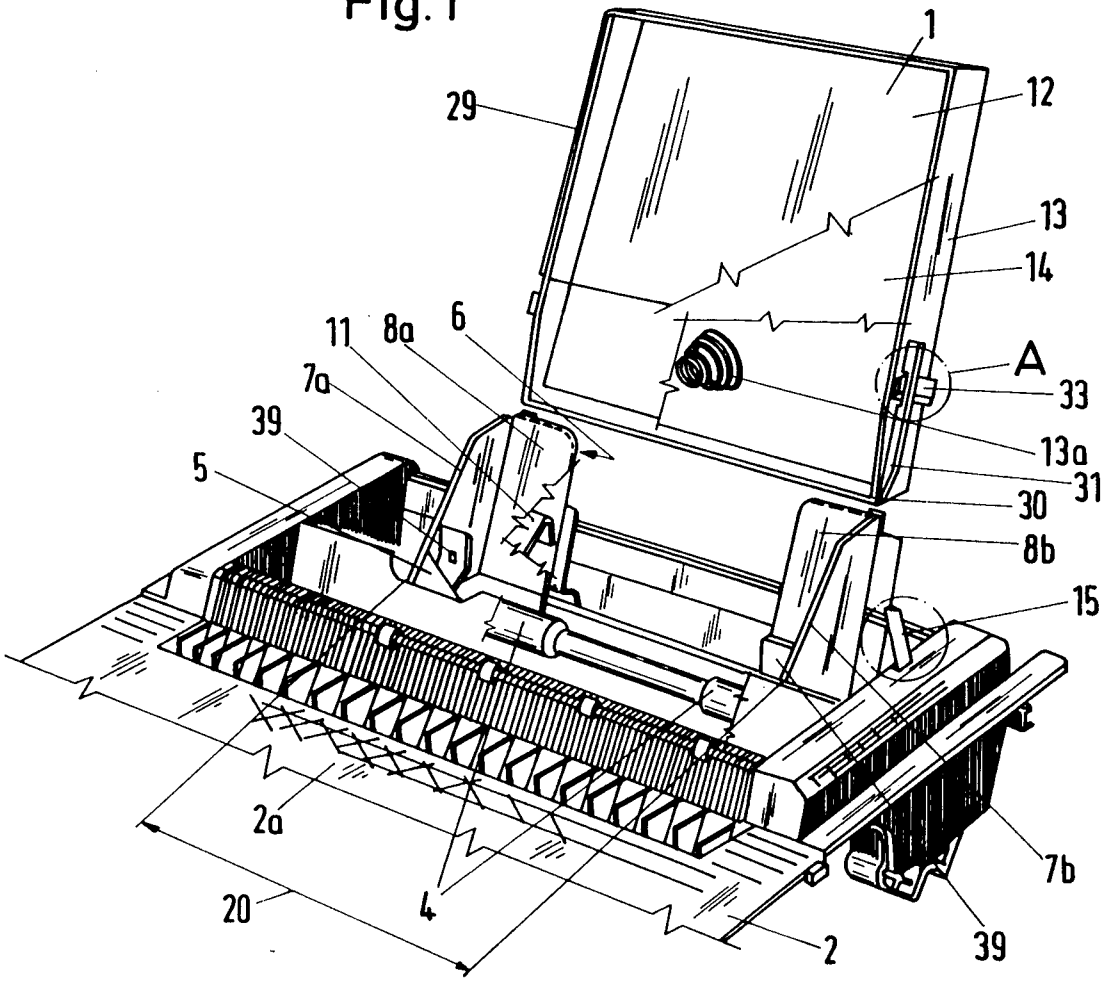
FIG. 1 is an elevated perspective view of an apparatus for the feeding of individual sheets and including an additional, physically separable paper cassette for introduction into mounted engagement with the apparatus in accordance with the invention.

The herein described and illustrated apparatus embodying the present invention is configured and constructed for operatively feeding individual sheets 1 into office machines 2 which may, by way of example and without limitation, consist of dot-matrix printers, thermal transfer printers, and laser page printers and the like. The individual sheets, as of paper, are typically introduced in the form of a stack 3 of the sheets 1. The stack 3 is supported in operative position against fixed delivery rolls 4 which are disposed in fixed relation to the machine 2 in sufficiently frictional engagement with the first or topmost individual sheet 1 of the stack 3 so that, as the rolls 4 are rotatively driven, the topmost sheet is separated from the next following sheet in the stack and fed to the machine 2. The delivery rolls 4 may be unidirectionally and/or bidirectionally driven through suitable selective rotations for this purpose. Thus, each individual sheet 1 is successively fed or driven from the stack 3 by the delivery rolls 4 and, as it leaves the stack, the sheet moves over the separating corners 5 which are fastened on a paper-receiving frame 6 of the apparatus.

The paper-receiving frame 6 is provided with lateral paper-guide frames or frame parts *7a, 7b*. The stack of sheets 3 lies, in the absence of other structure for this purpose, on one or two swing plates 8 or *8a, 8b*. The at least one such swing plate 8, in the form of a substantially rigid plate-like member or the like, is normally spring-biased for movement along a predetermined swing path.

Figure 4:
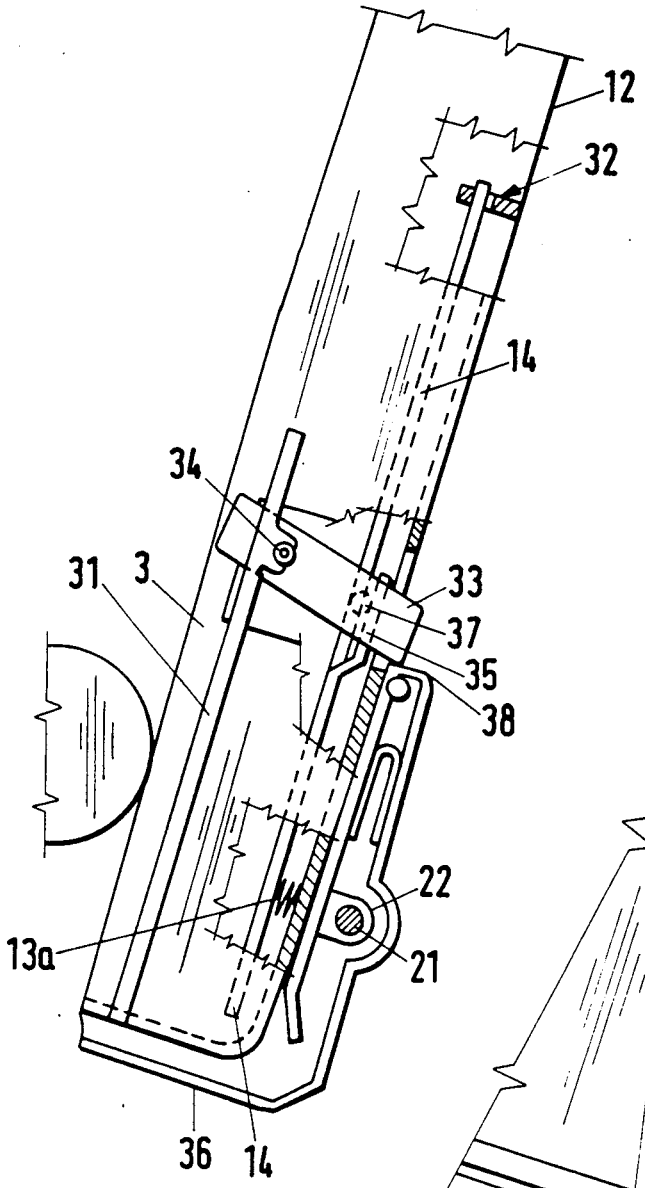
FIG. 4 is a partial sectional side view, partially broken away, along a plane parallel to the sectional plane of FIG. 2, within the region of lateral guidance of the additional paper cassette according to detail A in FIG. 1.

More particularly, in the herein disclosed embodiment of the invention the swing plate 8 (or pair of swing plates *8a, 8b*) is moveable, under the urgency of a spring 11, between two pivotally spaced or displaced positions 9, 10 (FIG. 2) and is lockable in the second spaced position 10. The displacement range of spring 11 is, accordingly, sufficiently large to accomodate such movement. The second spaced, locked position 10 of the plate 8 is illustrated in dashed lines in FIG. 2. In this second position 10, an additional paper cassette 12—which may, for example, hold different types or sizes of paper than that supported or supportable on the swing plate(s) 8—can then be inserted into mounted engagement with the apparatus. The additional paper cassette 12 consists of a housing or container 13 having an insertion bottom 14 which is displaceable by means of a swing bearing 32 under the urgency of a spring *13a* (FIG. 4). The housing or container 13 of the paper cassette 12 is introduced into operative engagement with the sheet feeding apparatus in supported abutment with the swing plate(s) 8, starting from the general position and orientation shown in FIG. 1.

Figure 3:
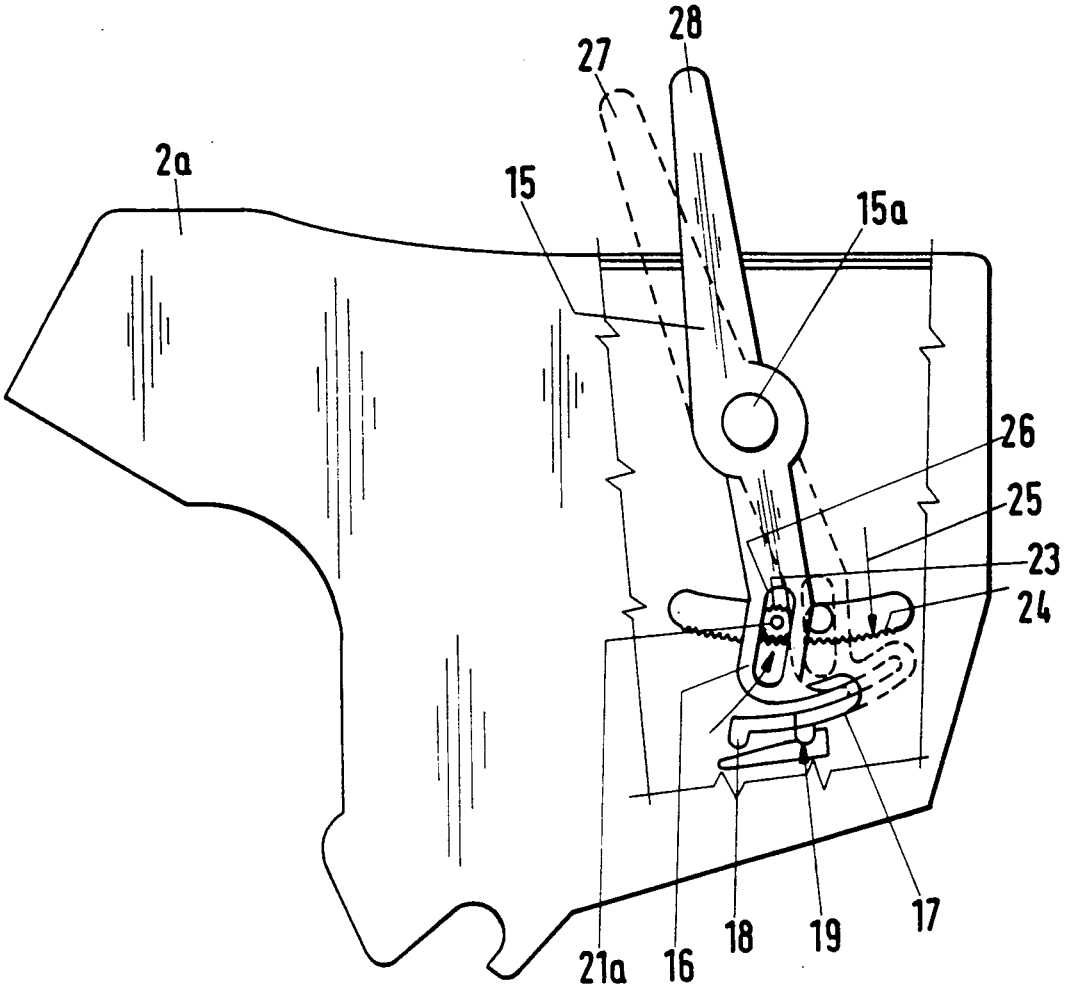
FIG. 3 is a sectional side view of the apparatus in the region around the detent lever.

Selective displacement of the swing plate(s) 8 is effected through pivotal movement of a double-arm detent lever 15 which is mounted on the apparatus frame *2a* by means of a shaft *15a*. As seen in FIG. 3, the lever 15 includes a second lever arm 16 that forms a spring arm 17 which, by way of a nose 18, engages a detent depression 19 defined in the frame *2a*.

A swing shaft 21 located captively in a guide housing 22 located on the bottom or underside *8c* of the swing plate(s) 8 extends over the full width or spacing 20 between the opposed lateral paper-guide frames *7a, 7b*. The ends of the swing shaft 21 carry rotatable gears 23. These gears 23 mesh with arcuate racks 24 which are associated with the frames *7a, 7b* and extend along and define a swing radius 25 corresponding to the intended motion or displacement range of the swing plate(s) 8. A substantially cylindrical end *21a* of the swing shaft 21 is additionally guided for substantially vertical movement in and along a longitudinal guide 26 in the detent lever 15 as the gears 23 ride along the arcuate racks 24. Thus, the first spaced or unlocked position 9 of the swing plate(s) 8 is determined by the delivery rolls 4 (which contact the topmost sheet 1 in the stack 3) in the rear position 28 (FIG. 3) of the detent lever 15, and the second spaced or locked position 10 is defined by the forward position 27 of the detent lever 15.

The additional paper cassette 12 with its spring-action insert bottom 14 forms a cassette frame 29 with separating corners 30 of its own opposite, when the cassette is mounted on the apparatus, the paper-receiving frame 6. The spring-action insertion bottom 14 of the cassette 12 can also be positionally locked and unlocked. Toward this end, and as illustrated in FIG. 4, the cassette 12 carries lateral guides 31. These guides 31 are effective for maintaining the same spacing between the circumference or peripheries of the fixed delivery rolls 4 and the cassette separating corners 30, with the cassette disposed in operative engagement with the apparatus, as the spacing between the rolls 4 and the separating corners 5 of the paper-guide frames *7a, 7b* when the additional cassette 12 is disengaged and lies separate and apart from the apparatus.

Figure 2:
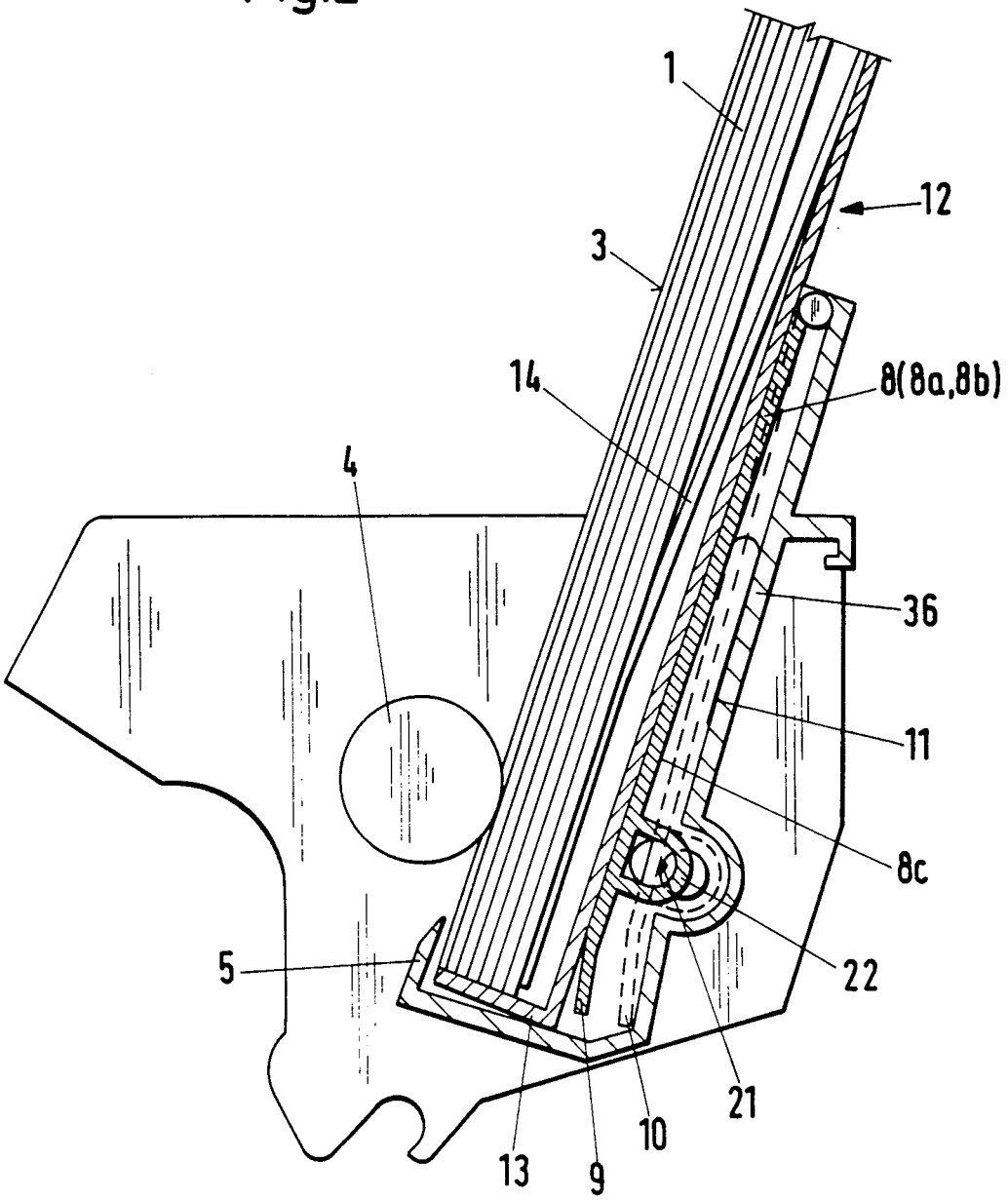
FIG. 2 is a sectional side view of the apparatus of FIG. 1 through the region of the swing plate.
Figure 5:
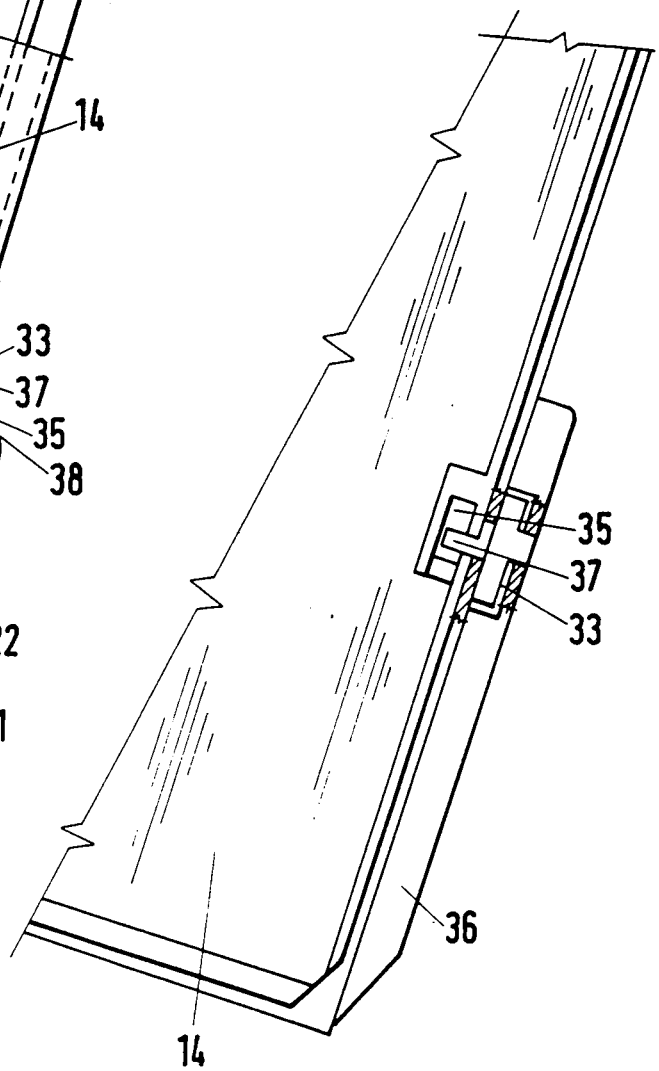
FIG. 5 is a top plan view of an edge region of the additional paper cassette of FIG. 4.

In use, the additional paper cassette 12 with its spring-action insertion bottom 14 is filled or partially filled with sheets 1 and is then introduced into mounted engagement with the apparatus. More particularly, in the pre-stressed or compressed position of the spring 13*a*—i.e. the filling condition of the cassette 12—a swing lever 33 is moved into its locked or interlocked position to prevent spring-driven displacement of the sheet-supporting bottom member 14. The swing lever 33 is mounted for pivotted movement about a shaft 34 on the cassette housing 13 and carries an interlock member 37 (FIG. 5) which is guidedly movable, as the swing lever 33 pivots, along a limited path 35. Upon insertion or mounted engagement of the additional paper cassette 12 with the apparatus, the swing lever 33 strikes, at 38, against a housing 36 for the swing plate(s) 8 causing pivotal movement of the lever 33 and carrying the interlock member 37 out of its locked position shown in FIG. 4, whereupon the released urgency of the spring 13*a* drives the insertion bottom 14 upwardly toward the delivery rolls 4. The topmost sheet 1 of the stack 3, which has already been placed supportedly on the cassette insertion bottom 14, is thereby driven upwardly against the delivery rolls 4. By then manually manipulating the detent lever 15 to pivot the lever 15 from its forward position 9 to its rear position 10 (FIG. 3), the force of the spring 11 is released and the swing plate(s) 8 and cassette frame 29 are pressed against the guide ribs 39 (FIG. 1). In this manner the uppermost sheet 1 in the stack 3 is pressed against the fixed delivery rolls 4 with a uniform force or pressure without regard to the spacing between the separating corners and the delivery rolls.

While there have been shown and described and pointed out fundamental novel features of the invention as applied to a currently preferred embodiment thereof, it will be understood that various omissions and substitutions and changes in the form and details of the device illustrated, and in its operation, may be made by those skilled in the art without departing from the spirit of the invention. It is the intention, therefore, to be limited only as indicated by the scope of the claims appended hereto.

What is claimed is:

1. Apparatus for feeding individual sheets (1) in an office machine (2) from a stack (3) of sheets, comprising:

a positionally-fixed delivery roll (4) for contact with an uppermost sheet (1) in the stack (3) and operatively rotatable for drawing the uppermost sheet from the stack;

a paper-receiving frame (6);

separating corners (5) on said frame (6) at a predetermined spacing to said delivery roll (4);

a spring action swing plate (8) for selectively and directly supporting a sheet stack (3) and movable between first and second positions, said plate (8) being spaced further from said delivery roll (4) in said second position than in said first position;

lateral paper-guide frames (*7a, 7b*) on said frame (6) and between which lies the sheet stack (3) in supported relation on said swing plate (8);

means for releasably locking said swing plate (8) in said second position; and an additional paper cassette (12) for releasably mounted engagement with said apparatus against said swing plate (8), said cassette comprising a housing (13) and a resilient insertion bottom (14) for supporting a stack (3) of sheets (1) in the absence of the provision of a sheet stack (3) directly on said swing plate (8).

2. Apparatus in accordance with claim 1, further comprising an apparatus frame (*2a*) and wherein said means comprises a double-armed detent lever (15) pivotally mounted to said apparatus frame (*2a*) and including a second lever arm (16) engageable with said apparatus frame (*2a*) for locking said swing plate (8) in said second position.

3. Apparatus in accordance with claim 1, wherein said means comprises a detent lever (15) mounted for pivotal movement along a radius of swing (25), said apparatus further comprising arcuate racks (24) associated with said lateral paper-guide frames (*7a, 7b*) and dimensioned in accordance with said detent lever radius of swing (25), a swing shaft (21) disposed supportingly under said swing plate (8) and extending spanningly between said lateral frames (*7a, 7b*), gears (23) carried rotatably on said swing shaft (21) and engageable in said racks (24), and a longitudinal guide (26) defined in said detent lever (15) for receiving an end (21*a*) of said swing shaft (21).

4. Apparatus in accordance with claim 1, wherein said additional paper cassette (12) further comprises spring means (13*a*) mounting said insertion bottom (14) for spring-action movement between first and second positions, a cassette frame (29), cassette separating corners (30) on said cassette frame (29), and means for releasably locking said insertion bottom (14) in said second position thereof against the return urgency of said spring means.

5. Apparatus in accordance with claim 1, wherein said additional paper cassette (12) further comprises cassette separating corners (30) and cassette lateral guides (31) for providing, when said cassette (12) is engagedly mounted with said apparatus, a spacing between said cassette separating corners (30) and said delivery roll (4) substantially equal to said predetermined spacing between said separating corners (5) on said apparatus frame (6) and said delivery roll (4).

6. Apparatus in accordance with claim 1, wherein said means comprises a detent lever (15) mounted for pivotal movement between a first position locking said swing plate (8) in its second position and a second position unlocking said swing plate (8); said cassette (12) further comprising spring means (13*a*) mounting said insertion bottom (14) for spring-action movement between a first released postion and a second filling position, and an interlock member (37) pivotable between a first position locking said insertion bottom (14) in its second filling position and a second position releasing said insertion bottom (14), said apparatus further comprising means (36, 38) engageable with said interlock member (37) as said paper cassette (12) is engageably mounted to said apparatus to move said interlock member (37) from its second to its first position so as to release said insertion bottom (14) from its second filling position and so that, as said detent lever (15) is then moved from its first to its second position, said swing plate (8) is correspondingly moved from its second to its first position to press the topmost sheet (1) of a stack (3) supported on said insertion bottom (14) against said delivery roll (4).

* * * * *